US005965833A

United States Patent [19]

Lindberg

[11] Patent Number: 5,965,833

[45] Date of Patent: Oct. 12, 1999

[54] ROTARY VALVE FOR A MUSICAL INSTRUMENT

[75] Inventor: Christian Lindberg, Stockholm, Sweden

[73] Assignee: United Musical Instruments U.S.A., Inc., Elkhart, Ind.

[21] Appl. No.: 09/157,761

[22] Filed: Sep. 21, 1998

Related U.S. Application Data

[60] Provisional application No. 60/062,045, Oct. 15, 1997.

[51] Int. Cl.[6] ..... G10D 7/10; G10D 9/04

[52] U.S. Cl. ..... 84/390; 84/395

[58] Field of Search ..... 84/390, 395, 396

[56] References Cited

U.S. PATENT DOCUMENTS

| | | |
|---|---|---|
| 5,919 | 11/1848 | Paine . |
| 461,131 | 10/1891 | Pietz . |
| 1,244,745 | 10/1917 | King . |
| 1,708,259 | 4/1929 | Charlton . |
| 2,106,281 | 1/1938 | Sattler . |
| 4,112,806 | 9/1978 | Thayer . |
| 4,213,371 | 7/1980 | Thayer . |
| 4,299,156 | 11/1981 | Thayer . |
| 4,469,002 | 9/1984 | Thayer . |
| 5,361,668 | 11/1994 | Andersen et al. . |

*Primary Examiner*—Stanley J. Witkowski
*Attorney, Agent, or Firm*—Barnes & Thornburg

[57] ABSTRACT

A rotary valve for selectively inserting and removing a slide loop from the sound path of a musical instrument is disclosed. The valve includes a cylindrical rotor housed in a cylindrical casing coupled to the instrument's lead pipe, main bore and slide loop leading and trailing ends. The rotor has two passages extending through it. The first passage is generally "Y" shaped with two leading ends and a trailing end, while the second passage is generally straight having a leading end and a trailing end. In a first valve position, the first leading end and the trailing end of the "Y" shaped rotor passage coaxially align with the instrument's lead pipe and main bore, respectively, providing an air pathway excluding the additional slide loop. In a second valve position, the second leading end and the trailing end of the "Y" shaped passage coaxially align with the instrument's lead pipe and slide loop leading end, respectively, while the leading end and trailing end of the straight rotor passage coaxially align with the instrument's slide loop trailing end and main bore, respectively, to provide an air pathway including the additional slide loop. The present rotor design eliminates undesirable noises during rotor operation common to prior rotors while not adversely affecting the integrity and quality of the air column during play.

14 Claims, 1 Drawing Sheet

ROTARY VALVE FOR A MUSICAL INSTRUMENT

BACKGROUND OF THE INVENTION

This application claims the benefit of provisional patent application Serial No. 60/062,045, filed Oct. 15, 1997.

This invention relates to a rotary fluid flow valve and more particularly to a rotary air valve for musical instruments.

One recognized method of changing tones in a musical wind instrument, particularly a brass instrument, is to change the length of the path an air column travels through the instrument. One method of accomplishing this is to provide the instrument with alternate loops of tubing of different lengths connected by one or more valves. As a valve is switched between alternate set positions, the air column is diverted through alternative desired combinations of loops resulting in different path lengths and thus different tones.

Rotary valves have long been used for musical instruments and are highly regarded for their quick action and relative simplicity of structure as compared to piston-type valves. Rotary valves have made strides in reducing overtones in the sound of the instrument caused by sound waves partially reflecting off the inside walls of the air passages as the air column travels through bends. Such partial reflection reduces the energy of the fundamental sound wave and produces undesirable overtones. Current rotary valves such as the Selmer-K valve and the Thayer valve reduce overtones by minimizing bends in the air passages through the valve and by providing air passage cross sections that are as congruent as possible at every point through the valve, thus minimizing any air passage characteristics that would create turbulence in an air column traveling through the passage.

These and other rotary valves, however, still suffer significant shortcomings. One such shortcoming is the production of an annoying "flop" sound when the switch is actuated. The sound is made as a result of the manner in which the valve breaks the air column as it is diverted from one air passage to another inside the valve and the alternative tubing is suddenly pressurized.

The rotary valve of the present invention represents a marked departure in the design of rotary valves for musical instruments. The present valve retains the essentially straight or slightly curved air passages through the valve thereby reducing unwanted harmonics, but includes a branched, generally "Y" shaped passage that remains in the air column as the valve is switched from one position to the other. The branched passage configuration minimizes the break in the air column while the valve is being switched and thereby eliminates the "flop" sound. Surprisingly, the "Y" branch of the passage does not deleteriously effect the integrity and quality of the air column during play. The result is a valve instrument with a rich, full bodied sound and significantly quieter valve action. The design of the present valve with the lack of the "flop" sound also allows for greater ease in playing soft note attacks while actuating the valve. The design of the valve also allows for a fuller, more stable tone at the loudest dynamics.

The rotary valve of the present invention provides a shorter arc of rotation to switch the valve from one position to the other compared to prior valve designs. This allows a shorter thumb/finger motion to actuate the valve during play.

According to one aspect of the present invention, a rotary valve is provided for a musical instrument which includes a lead pipe coupled to a mouthpiece, a main bore pipe leading to a horn bell, and an alternate slide loop having a leading end and a trailing end. The valve includes a casing configured to be coupled to the musical instrument, and a rotor configured to be mounted in the casing for rotation about a rotor axis between predetermined unswitched and switched positions. The rotor is formed to include a first generally "Y" shaped passage having first and second leading ends and a trailing end, and a second passage having a leading end and a trailing end. The first passage is configured to direct air from the lead pipe, through the first leading end of the "Y" shaped passage, out the trailing end, and through the main bore pipe leading to a horn bell when the rotor is in its unswitched position. The first and second passages also are configured to direct air from the lead pipe, through the second leading end of the "Y" shaped passage, out the trailing end, through the alternate slide loop, through the second passage, and through the main bore pipe leading to a horn bell when the rotor is in its switched position.

In the illustrated embodiment, the first and second leading ends of the first rotor passage are aligned at an acute angle relative to one another. The first leading end and the trailing end of the first passage are substantially coaxial with one another.

According to another aspect of the present invention, an improved rotary valve is provided for musical instruments having a lead pipe, a main bore pipe leading to a horn bell and an alternate slide loop with a leading end and a trailing end. The valve includes a cylindrical casing having a cylindrical sidewall, a top end, a bottom end, and an inner circumferential surface. It is understood that the casing may be slightly tapered, if desired. The casing is formed to include radially spaced apart first, second, third and fourth apertures extending through the cylindrical sidewall. The lead pipe, slide loop leading end, slide loop trailing end, and main bore pipe are coupled to the casing in communication with the first, second, third and fourth apertures, respectively. The valve also includes a cylindrical rotor having an outer circumferential surface. The rotor is coaxially mounted in the casing for rotation about a rotor axis between predetermined unswitched and switched positions such that the outer rotor surface maintains sealing contact with the casing inner circumferential surface. The rotor being formed to include a first generally "Y" shaped passage having first and second leading ends and a trailing end, and a second passage having a leading end and a trailing end. The first and second passages are aligned through the rotor so that when the rotor is in the unswitched position, the first leading end and the trailing end of the first passage are coaxially aligned with and in communication with the first and fourth casing apertures respectively while the second leading end of the first passage is in sealing contact with the casing inner circumferential surface. When the rotor is in the switched position, the second leading end and the trailing end of the first passage are coaxially aligned with and in communication with the first and second casing apertures, respectively, while the second leading end of the first passage is in sealing contact with the casing inner circumferential surface. Also in the switched position, the leading and trailing ends of the second rotor passage are coaxially aligned with and in communication with the third and fourth casing apertures respectively.

In the illustrated embodiment, the first and second leading ends of the first rotor passage are aligned at an acute angle relative to one another. The first leading end and the trailing end of the first rotor passage are substantially coaxial with one another.

Additional objects, features, and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE INVENTION

The present description and figures describe an embodiment of the invention adapted for use in a trombone, but practitioners in the field will readily appreciate that the valve can be adapted for use in other musical instruments such as french horns, tubas, marching field horns or trumpets and cornets. It is likewise readily apparent that multiple valves may be connected in series or in parallel to allow for multiple slide loops to be added to the air column pathway through the instrument.

Figure 1:
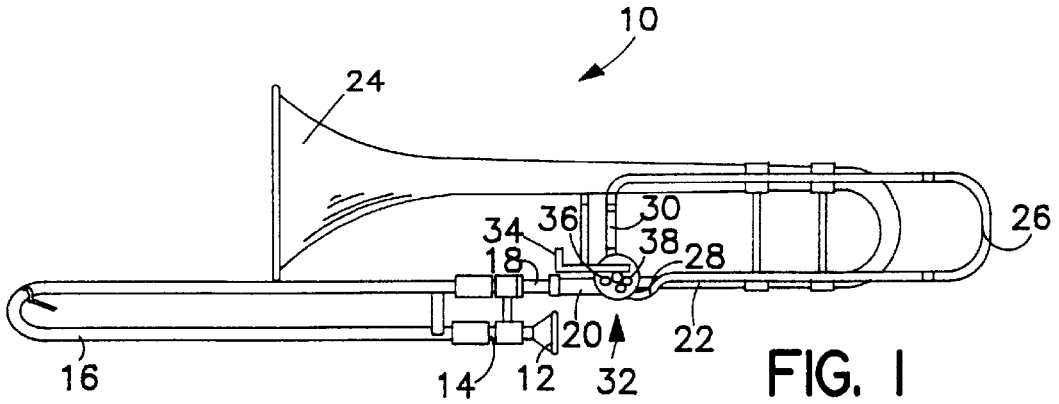
FIG. 1 is a side elevational view of a B-flat slide trombone which includes an alternate slide loop and a rotary valve of the present invention.

Referring now to the drawings, FIG. 1 illustrates an instrument 10 having a mouthpiece 12 coupled to a leading end 14 of a U-shaped hand slide 16. A trailing end 18 of hand slide 16 is coupled to a lead pipe 20. A main bore 22 leads to a horn bell 24. The instrument also includes at least one alternative slide loop 26, the slide loop 26 having a leading end 28 and a trailing end 30. The instrument has a rotary valve 32 to conduct the air column through alternate lengths of instrument tubing. The valve 32 is provided with a thumb trigger 34 to actuate the valve 32 and position stops 36 and 38 to position the valve 32 in predetermined switched and unswitched positions during play.

The rotary valve 32 comprises a cylindrical casing 50 housing a cylindrical rotor 80. The casing 50 has a cylindrical side wall 52, a bottom end 56 formed integrally with the side wall 52, and an inner circumferential surface 58. The casing 50 has radially aligned first 60, second 62, third 64 and fourth 66 apertures through the cylindrical side wall 52. The instrument's lead pipe 20, slide loop leading end 28, slide loop trailing end 30, and main bore 22 are coupled to and in communication with the first 60, second 62, third 64 and fourth 66 apertures of the casing, respectively.

The cylindrical rotor 80 has an outer circumferential surface 82, a top end 84, a bottom end 86 and an axle 88, and is coaxially mounted for rotation about the axle 88 inside the casing 50. The rotor outer circumferential surface 82 maintains continuous sealing contact with the casing inner circumferential surface 58. The rotor axle 88 is formed coaxially on or is coupled coaxially to the rotor top end 84 or alternatively the rotor bottom end 86, or preferably is a two part axle formed coaxially on or coupled coaxially to both the rotor top end 84 and rotor bottom end 86.

An axle portion 88 adjacent bottom end 86 of rotor 80 is located within an aperture 57 formed in bottom end 56 of casing 50. A removable bearing 54 is located inside casing 50. Removable bearing 54 receives the axle portion 88 adjacent top end 84 of rotor 80. A removable cap 55 is threadably coupled to the casing side wall 52. The cap 55 and bearing 54 are removable to permit removal, cleaning, and lubrication of the rotor 80. It is understood that the bottom end 56 of casing 50 can also be made removable, if desired.

The rotor 80 is formed to include a branched first passage 90 and an unbranched second passage 100. The branched first passage 90 has a first leading end 92, a second leading end 94, and a trailing end 96 and has the general shape of a "Y". It is surprising that the introduction of a branch in the air column pathway of the rotor 80 according to the present invention does not deleteriously affect the tone quality of the musical instrument despite the obvious compromise to laminar flow of an air column passing through the merge point of the leading ends 92 and 94. The result of the disclosed passage geometry, however, is a full-bodied sound over all dynamic ranges with the valve in either the unswitched or switched position. The valve 32 also eliminates the "flop" sound made by conventional valves which include separate air passages for diverting air flow to the alternate slide loop 26.

The unbranched second passage 100 has a leading end 102 and a trailing end 104. The unbranched second passage 100 may either be essentially straight or slightly arced, but is configured to minimize turbulence in the air column by minimizing the overall bending of the air pathway through the valve 32 and by minimizing change in the air pathway cross-sectional shape and size. Rotation of the rotor 80 is restricted to the arc of rotation between pre-determined switched and unswitched positions by stops 36 and 38.

In one embodiment of the present invention, branched first passage 90 is formed in rotor 80 to provide an essentially straight passage with an essentially circular cross-section extending from first leading end 92 to trailing end 96. A side branch passage with an essentially circular cross-section extends from second leading end 94 and merges with the passage extending from first leading end 92 to trailing end 96. The angle formed between an axis 93 of the passage extending from first leading end 92 to trailing end 96 and an axis 95 of the branch passage extending from second leading end 94 is between about 30° and about 60°. Illustratively, about 45°.

In another embodiment, branched first passage 90 is formed in rotor 80 to describe three passages extending inward from first leading end 92, second leading end 94 and trailing end 96, respectively, and merging within the rotor such that the angle formed between the axis 93 of the passage extending from first leading end 92 and the axis 95 of the passage extending from second leading end 94 is between about 30° and about 60°. The angle formed between the axis 93 of the passage extending from first leading end 92 or the axis 95 of the passage extending from the second leading end 94 and an axis 97 of the passage extending from trailing end 96 is between about 120° and about 180°.

In the illustrated embodiment, the merge junction for the passages forming branched first passage 90 is rounded smooth at appropriate arcs of curvature to eliminate abrupt bends, seams or corners in the direction of air flow through the passage.

Figure 2:
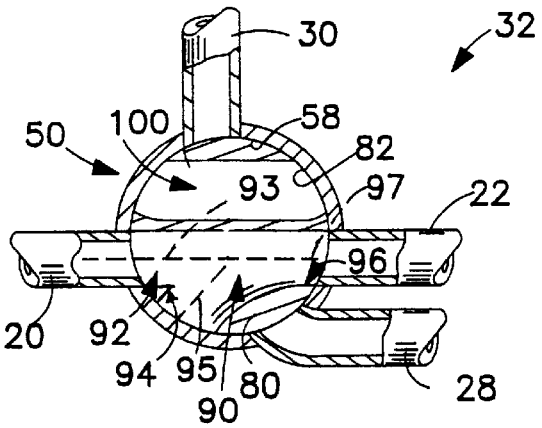
FIG. 2 is a sectional view taken transaxially through the rotary valve of FIG. 1 showing a first, generally Y-shaped passage and a second, essentially straight passage aligned with the instrument tubing in the unswitched position to provide an air pathway directly from the lead pipe to the horn bell, by-passing the alternate slide loop.

The first and second passages 90 and 100 are aligned in rotor 80 so that when rotor 80 is in the unswitched position, first leading end 92 and trailing end 96 of the first branched passage 90 are coaxially aligned with and in communication with the first 60 and fourth 66 casing apertures attached to lead pipe 20 and main bore 22, respectively, while second leading end 94 is sealed by the casing inner circumferential surface 58 as illustrated in FIG. 2.

Figure 3:
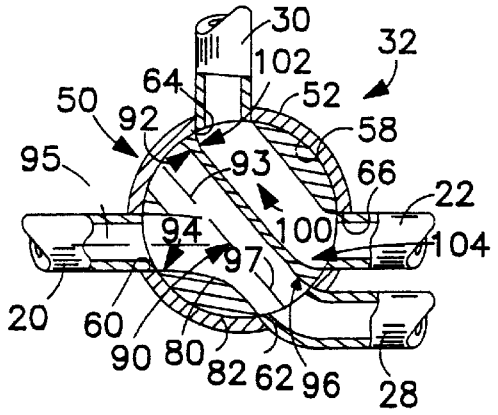
FIG. 3 is a sectional view taken transaxially through the rotary valve of FIG. 1 in the switched position to provide an air pathway from the lead pipe, through the alternate slide loop and on to the horn bell.
Figure 4:
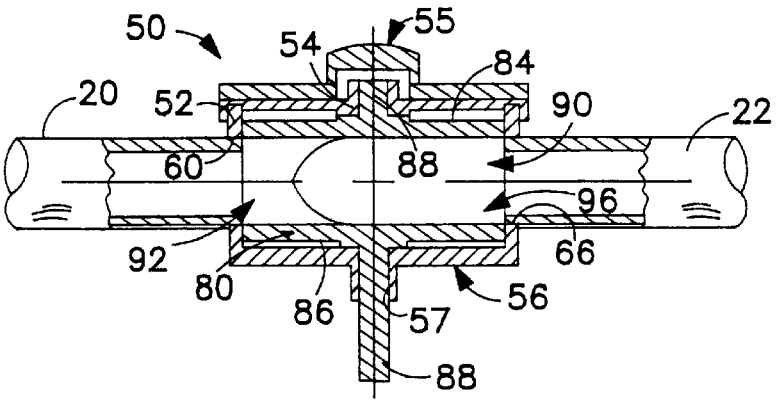
FIG. 4 is a sectional view taken axially through the rotary valve of FIG. 2.

The passages are further aligned in rotor 80 so that when rotor 80 is in the switched position, second leading end 94 and trailing end 96 of the branched first passage 90 are coaxially aligned with and in communication with first 60 and second 62 casing apertures attached to lead pipe 20 and slide loop leading end 28, respectively as illustrated in FIG. 3. Also in the switched position, the first leading end 92 is sealed by the casing inner circumferential surface 58, and leading end 102 and trailing end 104 of the unbranched second passage 100 are coaxially aligned with and in communication with third 64 and fourth 66 casing apertures attached to slide loop trailing end 30 and main bore 22, respectively.

The result of the alignment of first and second passages 90 and 100 through rotor 80 and the positioning of coupled lead pipe 20, slide loop leading end 28, slide loop trailing end 30 and main bore 22 on the casing 50 is that when rotor 80 is in the unswitched position of FIG. 2, an air column will pass from mouthpiece 12, through hand slide 16, into lead pipe 20, through valve 32 and directly into main bore 22 and on to horn bell 24. When rotor 80 is in the switched position of FIG. 3, an air column will pass from mouthpiece 12, through hand slide 16, into lead pipe 20, through valve 32 and then through alternative slide loop 26 before returning back through valve 32 and out through main bore 22 and on to horn bell 24, thus adding an additional length of tubing to the length of the air column pathway when valve 32 is in the switched position. The first 60, second 62, third 64 and fourth 66 casing apertures are preferably of the same size and shape as the cross sections of rotor passage ends 92, 94, 96, 102 and 104 to minimize any generation of turbulence in an air column passing through the valve.

Several mechanisms are known in the art for actuating valves in musical instruments including thumb triggers and finger keys. Linkage mechanisms between such triggers or keys can be direct mechanical linkages to a rotor axle or indirect linkages through strings or springs to a rotor axle. It should be readily apparent to the skilled artisan that any number of these known valve actuation mechanisms are readily adaptable to the present invention. An advantage of the present rotary valve is a reduced arc of rotation required to switch the valve from one position to the other allowing a shorter thumb/finger stroke with any of the common valve actuation mechanisms.

The illustrated embodiment of the present invention provides a solid rotor with the passages bored through or cast in the rotor. This embodiment provides greater ease in precise manufacture, greater stability of the rotor during use and greater ease of care. Alternative constructions of the rotor are also envisioned. For example, a lighter weight embodiment can be provided by minimizing the solid portions of the rotor to that minimal shape necessary to provide passages 90 and 100 in proper alignment across the cylindrical casing 50 and sealing contact with the casing inner circumferential surface 58. Another lighter weight embodiment may be provided by mounting tubes in a hollow cylindrical sleeve, the tubes being shaped and aligned to provide the above described first and second passages 90 and 100.

The casing 50, rotor body 80, and top bearing 54 are preferably formed from different types of copper alloys.

Although the invention has been described in detail with reference to a certain illustrated embodiment, variations and modifications exist within the scope and spirit of the present invention as defined in the following claims.

What is claimed:

1. A rotary valve for musical instruments having a lead pipe, a main bore pipe leading to a horn bell and an alternate slide loop with a leading end and a trailing end, the valve comprising:

a cylindrical casing having a cylindrical sidewall, a top end, a bottom end and an inner circumferential surface, the casing being formed to include radially spaced apart first, second, third and fourth apertures extending through the cylindrical sidewall, the lead pipe, slide loop leading end, slide loop trailing end, and main bore pipes being coupled to the casing in communication with the first, second, third and fourth apertures, respectively; and a cylindrical rotor having an outer circumferential surface, the rotor being coaxially mounted in the casing for rotation about a rotor axis between predetermined unswitched and switched positions such that the outer rotor surface maintains sealing contact with the casing inner circumferential surface, the rotor being formed to include a first generally "Y" shaped passage having first and second leading ends and a trailing end, and a second passage having a leading end and a trailing end, the first and second passages being aligned through the rotor so that when the rotor is in the unswitched position, the first leading end and the trailing end of the first passage are coaxially aligned with and in communication with the first and fourth casing apertures respectively while the second leading end of the first passage is in sealing contact with the casing inner circumferential surface, and when the rotor is in the switched position, the second leading end and the trailing end of the first passage are coaxially aligned with and in communication with the first and second casing apertures respectively while the second leading end of the first passage is in sealing contact with the casing inner circumferential surface, and the leading and trailing ends of the second rotor passage are coaxially aligned with and in communication with the third and fourth casing apertures respectively.

2. The rotary valve of claim 1, wherein the first and second leading ends of the first rotor passage are aligned at an acute angle relative to one another.

3. The rotary valve of claim 1, wherein the first leading end and the trailing end of the first rotor passage coaxial with one another.

4. The rotary valve of claim 3, wherein the first and second leading ends of the first rotor passage are aligned at an acute angle relative to one another.

5. The rotary valve of claim 1, wherein the second leading end and the trailing end of the first rotor passage are substantially coaxial with one another.

6. The rotary valve of claim 1, wherein the second passage has a generally straight shape.

7. The rotary valve of claim 1, wherein the second passage has an arcuate shape.

8. A rotary valve for a musical instrument which includes a lead pipe coupled to a mouthpiece, a main bore pipe leading to a horn bell, and an alternate slide loop having a leading end and a trailing end, the valve comprising:

a casing configured to be coupled to the musical instrument; and a rotor configured to be mounted in the casing for rotation about a rotor axis between predetermined unswitched and switched positions, the rotor being formed to include a first generally "Y" shaped passage having first and second leading ends and a trailing end, and a second passage having a leading end and a trailing end, the first passage being configured to direct air from the lead pipe, through the first leading end of the "Y" shaped passage, out the trailing end, and through the main bore pipe leading to a horn bell when the rotor is in its unswitched position, and the first and second passages also being configured to direct air from the lead pipe, through the second leading end of the "Y" shaped passage, out the trailing end, through the alternate slide loop, through the second passage, and through the main bore pipe leading to a horn bell when the rotor is in its switched position.

9. The rotary valve of claim 8, wherein the first and second leading ends of the first rotor passage are aligned at an acute angle relative to one another.

10. The rotary valve of claim 8, wherein the first leading end and the trailing end of the first rotor passage are substantially coaxial with one another.

11. The rotary valve of claim 10, wherein the first and second leading ends of the first rotor passage are aligned at an acute angle relative to one another.

12. The rotary valve of claim 8, wherein the second leading end and the trailing end of the first rotor passage are substantially coaxial with one another.

13. The rotary valve of claim 8, wherein the second passage has a generally straight shape.

14. The rotary valve of claim 8, wherein the second passage has an arcuate shape.

* * * * *